US012668856B2

(12) United States Patent
Wang et al.

(10) Patent No.: US 12,668,856 B2
(45) Date of Patent: Jun. 30, 2026

(54) METHOD FOR RECOVERING LITHIUM FROM LITHIUM-CONTAINING SOLUTION

(71) Applicant: BYD COMPANY LIMITED, Shenzhen (CN)

(72) Inventors: Minghao Wang, Shenzhen (CN); Junlan Lian, Shenzhen (CN); Hongye Lin, Shenzhen (CN)

(73) Assignee: BYD Company Limited, Shenzhen (CN)

( * ) Notice: Subject to any disclaimer, the term of this patent is extended or adjusted under 35 U.S.C. 154(b) by 919 days.

(21) Appl. No.: 17/868,564

(22) Filed: Jul. 19, 2022

(65) Prior Publication Data

US 2023/0097464 A1 Mar. 30, 2023

(30) Foreign Application Priority Data

Sep. 30, 2021 (CN) ..... 202111163658.0

(51) Int. Cl.
*C22B 26/12* (2006.01)
*C22B 3/24* (2006.01)
*C22B 3/44* (2006.01)

(52) U.S. Cl.
CPC ..... *C22B 26/12* (2013.01); *C22B 3/24* (2013.01); *C22B 3/44* (2013.01)

(58) Field of Classification Search
CPC ... C22B 26/12; C22B 3/24; C22B 3/44; B01J 20/041; B01J 20/08; Y02P 10/20
See application file for complete search history.

(56) References Cited

U.S. PATENT DOCUMENTS 6,547,836 B1 * 4/2003 Lukes ..... C01D 15/06 23/295 S
11,396,452 B2 * 7/2022 Riabtsev ..... B01J 39/07
(Continued)

FOREIGN PATENT DOCUMENTS

AU 2017405734 A1 * 10/2019 ..... C22B 26/12
CN 105771879 A 7/2016
(Continued)

OTHER PUBLICATIONS

English Translation of CN 112352059 A (Year: 2021).*
(Continued)

*Primary Examiner* — Paul A Wartalowicz
*Assistant Examiner* — Slone Elizabeth Simkins
(74) *Attorney, Agent, or Firm* — Sheppard Mullin Richter & Hampton LLP

(57) ABSTRACT

A method for recovering lithium from a lithium-containing solution is provided. A lithium-containing solution with an adjusted pH value or an unadjusted pH value is mixed with a meta-aluminate, and the pH value is adjusted to weak acid/neutral, so that lithium can be separated from the lithium-containing solution in the form of a precipitate of $Li_aX{\cdot}2Al(OH)_3{\cdot}nH_2O$. Then, the precipitate is converted into a lithium adsorbent of $(1\text{-}m)Li_aX{\cdot}2Al(OH)_3{\cdot}nH_2O$ and a $Li_aX$-containing filtrate through desorption of lithium. High-purity $Li_2CO_3$ is obtained by performing precipitation of lithium on the $Li_aX$-containing filtrate.

10 Claims, 2 Drawing Sheets

(56) References Cited

U.S. PATENT DOCUMENTS

| | | | | |
|---|---|---|---|---|
| 11,865,531 | B2 * | 1/2024 | Snydacker | C22B 26/12 |
| 2012/0302779 | A1 | 11/2012 | Ueda | |
| 2016/0016809 | A1 * | 1/2016 | Jeong | C01F 5/24 423/164 |
| 2023/0330622 | A1 * | 10/2023 | Yang | B01J 39/02 |

FOREIGN PATENT DOCUMENTS

| | | | | | |
|---|---|---|---|---|---|
| CN | 106315629 | A | | 1/2017 | |
| CN | 106745102 | A | | 5/2017 | |
| CN | 107930575 | A | | 4/2018 | |
| CN | 108178170 | A | | 6/2018 | |
| CN | 108543514 | A | | 9/2018 | |
| CN | 108975358 | A | | 12/2018 | |
| CN | 108993376 | A | | 12/2018 | |
| CN | 110013822 | A | | 7/2019 | |
| CN | 111533146 | A | | 8/2020 | |
| CN | 111592017 | A | * | 8/2020 | C01D 15/04 |
| CN | 112158865 | A | | 1/2021 | |
| CN | 112352059 | A | * | 2/2021 | B01D 15/362 |
| CN | 112717468 | A | | 4/2021 | |
| CN | 112808226 | A | | 5/2021 | |
| CN | 110078099 | B | * | 8/2021 | C01D 15/08 |
| CN | 109759006 | B | * | 5/2022 | |
| GB | 804962 | A | | 11/1958 | |
| WO | 2015097203 | A1 | | 7/2015 | |

OTHER PUBLICATIONS

English Translation of CN 110078009 B (Year: 2021).*
English Translation of CN 109759006 B (Year: 2022).*
English Translation of AU 2017405734 A1 (Year: 2019).*
English Translation of CN 11078099 B (Year: 2021).*
English Translation of CN 111592017 A (Year: 2020).*
English Translation of CN 107930575 A (Year: 2018).*

* cited by examiner

METHOD FOR RECOVERING LITHIUM FROM LITHIUM-CONTAINING SOLUTION

CROSS-REFERENCE TO RELATED APPLICATIONS

This application is based on and claims priority to and benefits of Chinese Patent Application No. 202111163658.0, filed with the China National Intellectual Property Administration on Sep. 30, 2021. The entire content of the above-identified application is incorporated herein by reference.

FIELD

The disclosure relates to the field of environmental protection and resource recycling, and specifically, to a method for recovering lithium from a lithium-containing solution.

BACKGROUND

Lithium carbonate is a basic material for preparing various industrial lithium salts. However, in the preparation process of lithium carbonate, a lithium-containing solution with a large amount of $Li^+$ and a certain amount of $Na^+$ and $K^+$ remaining will be produced from the lithium carbonate due to a certain water solubility thereof. In industry, a lithium-containing solution is generally spread and sun-dried or strongly evaporated to remove $Na^+$ and $K^+$ contained therein, and is adsorbed, desorbed, and concentrated with membrane to recover lithium. The foregoing method for recovering lithium has a long cycle together with poor separation of $Na^+$ and $K^+$ and a low recovery rate of lithium.

SUMMARY

In view of this, the disclosure provides a method for recovering lithium from a lithium-containing solution. In this method, the efficient separation of lithium from impurity ions is realized, and a recyclable lithium adsorbent is prepared while the lithium is recovered, which can realize further recovery of the lithium-containing solution. This method not only has a high recovery rate of lithium from the lithium-containing solution and a high comprehensive recovery rate of resources, but also has a simple process and a low energy consumption, and is environmentally friendly.

The disclosure provides a method for recovering lithium from a lithium-containing solution, including the following steps:

(1) precipitating lithium from the lithium-containing solution in the following manner a) or b):

a) adjusting a pH value of the lithium-containing solution to 5-6, mixing the adjusted lithium-containing solution with a meta-aluminate solution, and standing for aging, to obtain a precipitation solution containing a first precipitate of $Li(OH)\cdot 2Al(OH)_3nH_2O$, wherein n=1-3; and adjusting a pH value of the precipitation solution to 6-7, and performing filtering and washing, to obtain a precipitate of $Li_aX\cdot 2Al(OH)_3nH_2O$ and a first filtrate; or b) mixing the lithium-containing solution with a meta-aluminate solution, adjusting a pH value of the mixture to 5-7, standing for aging after reaction, and performing filtering and precipitating, to obtain a precipitate of $Li_aX\cdot 2Al(OH)_3nH_2O$ and a first filtrate, wherein X is an anion of an acid solution for precipitating of the pH value, and a=1 or 2;

(2) desorption of lithium: mixing the precipitate of $Li_aX\cdot 2Al(OH)_3nH_2O$ with water and stirring for reaction, and filtering the mixture to obtain a lithium adsorbent of $(1-m)Li_aX\cdot 2Al(OH)_3nH_2O$ and a $Li_aX$-containing filtrate, wherein m=0.1-0.9; and (3) precipitation of lithium: evaporating and concentrating the $Li_aX$-containing filtrate, adding a carbonate and stirring for reaction, and performing filtering and washing, to obtain a precipitate of $Li_2CO_3$.

In an embodiment of the disclosure, the lithium-containing solution is an alkaline solution containing a large amount of $Li^+$ and impurity ions such as $CO_3^{2-}$, $Na^+$, and $K^+$, for example, a precipitation of lithium mother liquor produced in the process of extracting lithium from a salt lake.

In the manner a), the pH value of the lithium-containing solution system is adjusted to 5-6 by adding the acid solution, to react with a carbonate ion in the lithium-containing solution to form carbon dioxide to escape, so as to remove the carbonate ion in the system. It should be noted that, the lithium-containing solution system is mixed with the meta-aluminate solution for precipitation of aluminum salt when the pH value of the lithium-containing solution system remains at 5-6 and there are no more bubbles to ensure that no carbonate ions remain in the system. In this process, $Li^+$ in the lithium-containing solution reacts with meta-aluminate to form the first precipitate of $Li(OH)\cdot 2Al(OH)_3nH_2O$, precipitating the $Li^+$ from the lithium-containing solution.

In some embodiments of the disclosure, the foregoing lithium-containing solution is stirred at a stirring rate of 100-500 rpm. An appropriate stirring rate helps to promote the reaction between the carbonate ion in the lithium-containing solution system and a hydrogen ion in the acid solution.

The pH value of the system is adjusted to 6-7 by adding an acid solution to the precipitation solution containing the first precipitate of $Li(OH)\cdot 2Al(OH)_3\cdot nH_2O$, so that the precipitate of $Li(OH)\cdot 2Al(OH)_3\cdot nH_2O$ can be converted into the precipitate of $Li_aX\cdot 2Al(OH)_3\cdot nH_2O$, to perform a subsequent desorption of lithium reaction more efficiently and produce the lithium adsorbent of $(1-m)Li_aX\cdot 2Al(OH)_3\cdot nH_2O$ with a stronger adsorption capability. X is an anion of the acid solution for adjusting the pH value, and a=1 or 2. X and a may be determined according to the type of the acid solution used for adjusting the pH value.

In step (1), the acid solution for adjusting the pH value may be one of sulfuric acid, hydrochloric acid, nitric acid or acetic acid. The type of the acid solution is selected according to the type of an anion in the lithium-containing solution. That is, for a chloride-type lithium-containing solution, the acid solution is hydrochloric acid; for a sulfate-type lithium-containing solution, the acid solution is sulfuric acid; for a nitrate-type lithium-containing solution, the acid solution is nitric acid; and for an acetate-type lithium-containing solution, the acid solution is acetic acid. In this way, additional impurity ions can be prevented from being introduced to the system. When the acid solution for adjusting the pH value is hydrochloric acid, X is $Cl^-$. When the acid solution is nitric acid, X is $NO_3^-$. When the acid solution is acetic acid, X is $CH_3COO^-$. In the foregoing three cases, a=1. When the acid solution is sulfuric acid, X is $SO_4^{2-}$, and a=2.

In some embodiments of the disclosure, the foregoing precipitation solution is stirred at a stirring rate of 100-300 rpm. Further, in some embodiments of the disclosure, the system is further stirred for 0.5-1 h after the pH value is adjusted to 6-7. An appropriate stirring rate and stirring time can promote complete conversion of $Li(OH)\cdot 2Al(OH)_3\cdot nH_2O$.

In the manner b), the lithium-containing solution is directly mixed with the meta-aluminate solution, and a pH value of the system is adjusted to 5-7 with an acid solution, to directly obtain a precipitate of $Li_aX\cdot 2Al(OH)_3\cdot nH_2O$ and a first filtrate. It should be noted that, in the process of preparing the precipitate of $Li_aX\cdot 2Al(OH)_3\cdot nH_2O$ in the manner b), the method of forming carbon dioxide through reaction is also used to remove a carbonate ion in the system. To ensure that no carbonate ions remain in the system, the filtering is performed when there are no more bubbles in the system.

In some embodiments of the disclosure, the mixed solution of the meta-aluminate solution and the lithium-containing solution obtained in the manner b) is stirred at a stirring rate of 100-500 rpm. An appropriate stirring rate can make reactants react completely.

In some embodiments of the disclosure, in both the manners a) and b), the system may be sonicated during the reaction between the acid solution and the carbonate ion. Sonication can effectively remove the carbon dioxide bubbles generated by the reaction between the carbonate ion and the acid solution in the foregoing system.

In some embodiments of the disclosure, the acid solution for adjusting the pH value of the lithium-containing solution in the manner a) and the acid solution used in the manner b) are both formulated with one of a commercially available concentrated hydrochloric acid (37 wt %), a commercially available concentrated sulfuric acid (98 wt %), a commercially available acetic acid (99.5 wt %) or a commercially available concentrated nitric acid (68 wt %) and water in a mass ratio of (1-10):1; and the acid solution for adjusting the pH value of the precipitation solution in the manner a) is an acid solution with a concentration of 2-20 wt %. An acid solution with an appropriate concentration is beneficial for reactants to fully react.

In the disclosure, in order to avoid introducing additional impurity ions, the meta-aluminate solution is generally a sodium meta-aluminate solution, a potassium meta-aluminate solution or an ammonium meta-aluminate solution. In some embodiments of the disclosure, a mass concentration of the meta-aluminate solution is 4-16 wt %. A meta-aluminate solution with an appropriate concentration helps to ensure the rate of the precipitation reaction of $Li^+$.

In some embodiments of the disclosure, a meta-aluminate is mixed with water and stirred at 25-90° C. for dissolution with a stirring rate of 100-500 rpm and a stirring time of 0.5-3 h, until the solution is clear and transparent, so that the meta-aluminate is completely dissolved.

In an embodiment of the disclosure, the lithium-containing solution is mixed with the meta-aluminate solution in a molar ratio of Li:Al of (1.05-1.3):2. The mixing of the meta-aluminate solution with the excessive lithium-containing solution can ensure that the meta-aluminate reacts completely and no aluminum remains in the system after the reaction.

In some embodiments of the disclosure, there may be three manners for mixing the meta-aluminate solution with the lithium-containing solution, including: 1) adding the lithium-containing solution to the meta-aluminate solution by using a peristaltic pump, 2) adding the meta-aluminate solution to the lithium-containing solution by using a peristaltic pump, or 3) mixing the lithium-containing solution with the meta-aluminate solution in a co-current manner.

In some embodiments of the disclosure, in the manner 1), the flow rate of the lithium-containing solution is 20-5000 mL/min; in the manner 2), the flow rate of the meta-aluminate solution is 20-5000 mL/min; and in the manner 3), the flow rates of the lithium-containing solution and the meta-aluminate solution are both 20-5000 mL/min. In addition, the specific liquid flow rate is determined according to concentrations of the meta-aluminate solution and the lithium-containing solution and the molar ratio of Li to Al in practical production.

Further, in some embodiments of the disclosure, the mixed solution of the lithium-containing solution and the meta-aluminate solution is stirred with a stirring rate of 100-500 rpm and a stirring time of 0.5-1 h, and the acid solution is added to adjust the pH value of the system after the lithium-containing solution and the meta-aluminate solution are completely mixed.

In an embodiment of the disclosure, in step (1), a time of the standing for aging is 1-24 h and a temperature of the standing for aging is 5-30° C. The standing for aging is performed for reactants (mainly including $Li^+$ and $AlO_2^-$) in the foregoing mixed solution to be fully reacted and for a generated suspended solid to be settled, promoting the dissolution of tiny particles and the growth of large particles, so that particle sizes of the precipitate of $Li(OH)\cdot 2Al(OH)_3\cdot nH_2O$ obtained in the manner a) and the precipitate of $Li_aX\cdot 2Al(OH)_3\cdot nH_2O$ obtained in the manner b) are more uniform, to help with the subsequent filtering and washing. An appropriate aging temperature can ensure that the structure of the foregoing precipitates will not be damaged due to desorption of lithium.

In an embodiment of the disclosure, step (1) further includes: during adjusting the pH value, collecting carbon dioxide produced by the lithium-containing solution and injecting the same into an alkaline solution to obtain a carbonate, where the alkaline solution is NaOH or KOH, and the carbonate is $Na_2CO_3$ or $K_2CO_3$. In this way, resources can be fully used, the comprehensive recovery rate of resources can be improved, and the production cost can be reduced. In addition, the selection of NaOH or KOH avoids introducing additional impurity ions. In some embodiments of the disclosure, a concentration of the alkaline solution is 4-15 wt %. An appropriate alkaline solution concentration can ensure the reaction rate of carbon dioxide.

In some embodiments of the disclosure, the $CO_2$ produced in the reaction in step (1) is injected into a buffer storage tank, and the same amount of alkaline solution with an equal concentration is poured into sealed reactors No. 1 and No. 2, and the $CO_2$ in the buffer storage tank is injected into the sealed reactor No. 1 in a mass ratio of the $CO_2$ to the alkaline solution in the sealed reactor No. 1 of (1.1-1.3):1. When pressures in the sealed reactors remain unchanged, the solution in the sealed reactor No. 1 is transferred to the sealed reactor No. 2 and stirred for 0.5-3 h for reaction with a stirring rate of 100-500 rpm. Finally, a carbonate solution for precipitation of lithium is obtained.

In step (2), the precipitate of $Li_aX\cdot 2Al(OH)_3\cdot nH_2O$ is mixed with water to partially desorb lithium from $Li_aX\cdot 2Al(OH)_3\cdot nH_2O$, and to prepare the lithium adsorbent of $(1-m)Li_aX\cdot 2Al(OH)_3\cdot nH_2O$ with a better lithium adsorption capability and the $Li_aX$-containing filtrate for preparing lithium carbonate in the subsequent step. The reaction for desorption of lithium is as follows:

$Li_aX\cdot 2Al(OH)_3\cdot nH_2O \leftrightarrow (1-m)Li_aX\cdot 2Al(OH)_3\cdot nH_2O + mLi_aX$, (m=0.1-0.9). The reverse reaction of the foregoing reaction is the adsorption of lithium by the lithium adsorbent.

In an embodiment of the disclosure, the precipitate of $Li_aX \cdot 2Al(OH)_3 \cdot nH_2O$ is mixed with water in a mass ratio of 1:(1-50), and stirred at 20-60° C. for 1-24 h. The control of the temperature and reaction time promotes the foregoing reaction to carry out forward, to improve the yield of the lithium adsorbent and the $Li_aX$-containing filtrate. The adsorption and recovery of lithium through the route described in the foregoing reaction can improve the efficiency of the adsorption and subsequent desorption of lithium, thereby increasing the recovery rate of lithium.

In the disclosure, it is only necessary to introduce metaaluminate into the lithium-containing solution and adjust the pH value to synchronously obtain the recyclable lithium adsorbent $(1-m)Li_aX \cdot 2Al(OH)_3 \cdot nH_2O$ during the recovery of lithium. The preparation is a simple in process and is low in cost.

In an embodiment of the disclosure, for the lithium adsorbent $(1-m)Li_aX \cdot 2Al(OH)_3 \cdot nH_2O$, a D50 particle size is 20-100 μm and a particle size range is 5-300 μm. An appropriate particle size can ensure the adsorption efficiency of the lithium adsorbent.

In step (3), in order to achieve the precipitation of lithium, the $Li_aX$-containing filtrate is evaporated and concentrated, a carbonate is added and stirred for reaction to convert the lithium into the precipitate of lithium carbonate, and the precipitate of lithium carbonate is filtered out and washed to obtain the precipitate of $Li_2CO_3$. Step (3) further includes drying the precipitate of $Li_2CO_3$ with a drying temperature of 90-150° C. and a drying time of 2-3 h.

In an embodiment of the disclosure, the $Li_aX$-containing filtrate is evaporated and concentrated until a concentration of lithium is 15-25 g/L. The evaporation and concentration of the $Li_aX$-containing filtrate increases the concentration of $Li^+$ in the solution, which is beneficial for the subsequent lithium precipitation reaction and the precipitation of $Li_2CO_3$, and helps the subsequent filtering process easier to carry out.

In an embodiment of the disclosure, the carbonate is added to the $Li_aX$-containing filtrate at 50-90° C. with stirring at the same time. In some embodiments of the disclosure, the rate of the stirring is 100-500 rpm, the stirring is further performed for 0.5-1 h after the carbonate is added completely, and standing is performed for 1-5 h, to ensure that $Li^+$reacts completely. Lithium carbonate is slightly soluble in water, and the solubility of lithium carbonate in water decreases with the increase of the temperature. Therefore, the temperature of the system needs to be kept at 50-90° C., to help lithium carbonate to be precipitated from the solution, thereby increasing the amount of lithium involved in the reaction in the system.

In some embodiments of the disclosure, the molar ratio of Li in the $Li_aX$-containing filtrate to carbonate ion in the carbonate is (1.05-1.3):2. The carbonate solution is a sodium carbonate solution or potassium carbonate solution with a concentration of 5-20 wt %. The addition of the excessive carbonate can ensure the amount of lithium ion involved in the reaction in the system, thereby ensuring the recovery rate of lithium from the $Li_aX$-containing filtrate.

In an embodiment of the disclosure, step (2) further includes the following treatment steps:

c) adsorption of balance lithium: the lithium adsorbent $(1-m)Li_aX \cdot 2Al(OH)_3 \cdot nH_2O$ is added to the first filtrate, stirred at 20-60° C., to adsorb a lithium ion in the first filtrate, and filtering and washing are performed, to obtain a second precipitate of $Li_aX \cdot 2Al(OH)_3 \cdot nH_2O$;

d) desorption of lithium: the second precipitate is added to water and stirred for reaction, and the mixture is filtered to obtain a second lithium adsorbent of $(1-m)Li_aX \cdot 2Al(OH)_3 \cdot nH_2O$ and a lithium-desorbed filtrate (that is, a second $Li_aX$-containing filtrate); and e) precipitation of lithium: the lithium-desorbed filtrate is evaporated and concentrated, a carbonate is added and stirred for reaction, and filtering and washing are performed, to obtain a precipitate of $Li_2CO_3$.

In some embodiments of the disclosure, in the process of adsorption of balance lithium in step c), the solid-liquid ratio of the added lithium adsorbent to the first filtrate is 1:(1-30) kg/L. An appropriate amount of the lithium adsorbent ensures the adsorption rate of the balance lithium remaining in the first filtrate. The recovery rate of lithium from the lithium-containing solution can be significantly increased by the adsorption of balance lithium in step c).

Parameters of the desorption of lithium in step d) may be shared with the parameter range defined by the desorption of lithium in step (2), and parameters of the precipitation of lithium in step e) may be shared with the parameter range defined by the precipitation of lithium in step (3).

In some embodiments of the disclosure, the second $Li_aX$-containing filtrate obtained in step d) and the $Li_aX$-containing filtrate obtained by the desorption of lithium in step (2) may also be combined to undergo the evaporation and concentration in step (3) together, a carbonate is added at 50-90° C. and stirred for reaction, and filtering and washing are performed, to obtain the precipitate of $Li_2CO_3$. In some cases, for example, in a case that no new $Li_aX$-containing filtrates are produced later, the production cost can be reduced and the duration can be shortened by combining the two obtained $Li_aX$-containing filtrates for evaporation and concentration.

In addition, the lithium adsorbent and the second lithium adsorbent obtained in the foregoing steps may either be directly used for the adsorption of balance lithium in the technical process provided in the disclosure or be partially used for other lithium recovering scenarios after drying, for example, a brine adsorption process at the front stage of a process of lithium extraction from a salt lake. A heating and drying temperature is 70-90° C. and a heating and drying time is 2-3 h. In some embodiments of the disclosure, the dried lithium adsorbent may be ground or air-crushed, to eliminate powder compaction and make lithium adsorbent particles finer and more uniform, thereby ensuring the adsorption efficiency of the lithium adsorbent in the process of brine adsorption.

In an embodiment of the disclosure, steps (1), (2), and (3) all include filtering and washing, where in the washing: the obtained precipitate is spray-washed with pure water with a ratio of a water spraying amount per unit time to the precipitation of (0.1-1):1 L/kg. An appropriate amount of water can effectively remove impurity ions such as $Na^+$ and $K^+$ in the precipitate, and will not cause the desorption of lithium from the precipitate, which ensures the recovery rate of lithium.

In an embodiment of the disclosure, in the filtering in steps (1), (2), and (3): the filtering is performed under a negative pressure of 0.04-0.07 MPa, and a mesh number of a filter medium for the filtering is 300-5000. A filter medium with an appropriate mesh number and an appropriate negative pressure can avoid the loss of some tiny particles during filtering, thereby ensuring the recovery rate of lithium.

In some embodiments of the disclosure, the filtering further includes secondary filtering, where the secondary filtering is carried out by using a precise bag filter with a precision of 3-5 μm. In this way, the loss of tiny particles caused by a filter medium with a small mesh number which is likely to allow some tiny particles to enter the filtrate can be avoided. The tiny particles obtained after the secondary filtering are returned to undergo standing for aging. The secondary filtering can avoid the loss of tiny particles, thereby further increasing the recovery rate of lithium.

In an embodiment of the disclosure, in step (3), a second filtrate is also obtained in addition to $Li_2CO_3$. Step (3) further includes: adding the second filtrate to the lithium-containing solution in step (1). Lithium remaining in the second filtrate can be recovered by the foregoing operation, which further increases the recovery rate of lithium.

The disclosure provides a method for recovering lithium from a lithium-containing solution. In this method, the pH value of the lithium-containing solution is adjusted and a meta-aluminate is added, to precipitate lithium from the lithium-containing solution and remove a large amount of carbonate ions present in the lithium-containing solution. Then, the precipitate is filtered out, washed, and lithium-desorbed. A recyclable lithium adsorbent with strong adsorption is obtained while lithium is recovered. In addition, the washing on the precipitate obtained in the steps can remove a large amount of impurity ions such as $K^+$ and $Na^+$ entrained in the precipitate. Finally, a high-purity $Li_2CO_3$ product is prepared by adding a carbonate to a lithium-containing filtrate.

In this method, the efficient separation of lithium from impurity ions is realized, and a recyclable lithium adsorbent is prepared while the lithium is recovered, which can realize further recovery of the lithium-containing solution. This method not only has a high recovery rate of lithium from the lithium-containing solution, but also has a simple process, is environmentally friendly, and is convenient for large-scale industrial production.

DETAILED DESCRIPTION

The technical solution of the embodiments of the disclosure is described in detail with a plurality of embodiments in the following.

Embodiment 1

Figure 1:
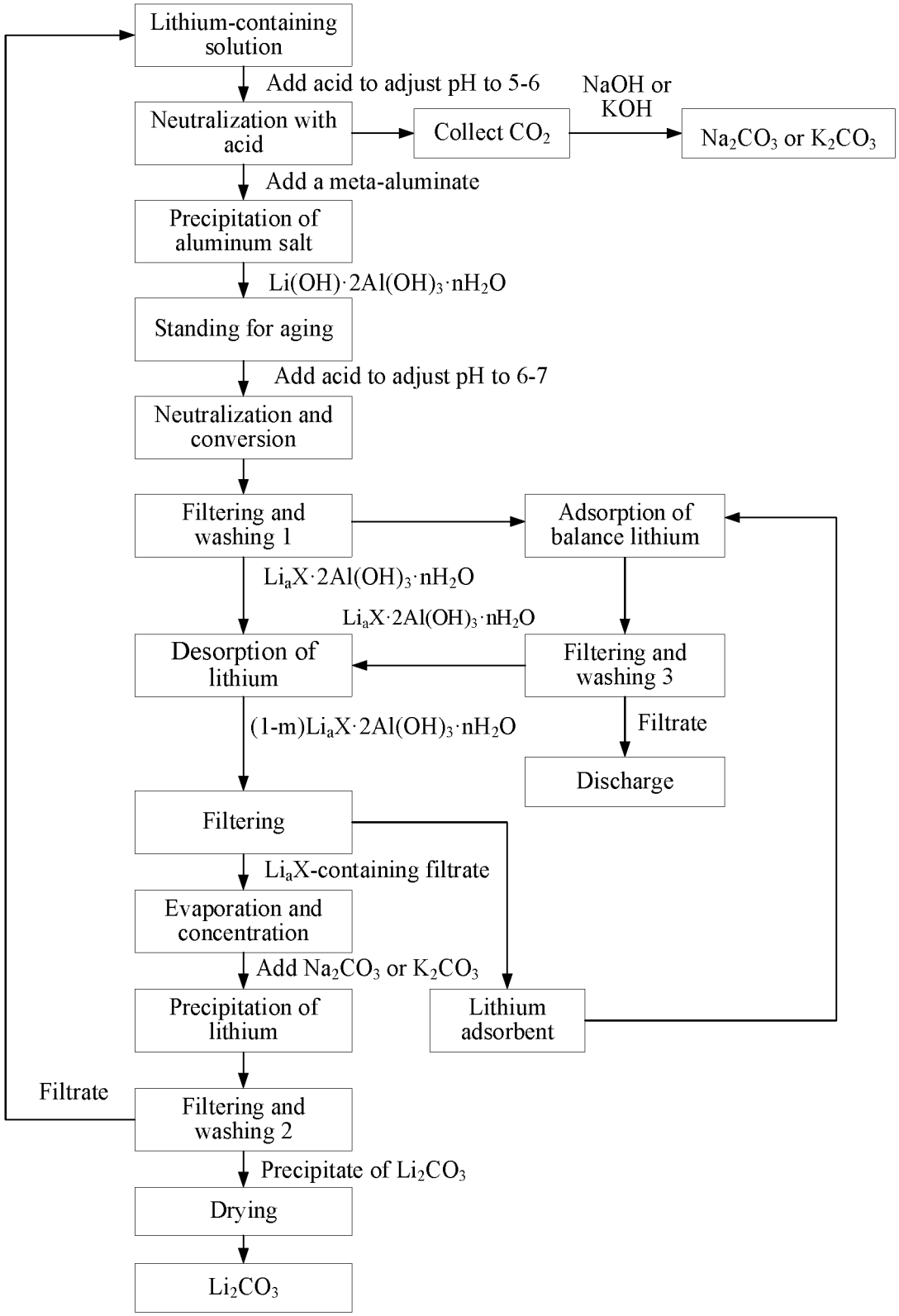
FIG. 1 is a process flowchart of lithium recovery according to Embodiment 1 of the disclosure.

Referring to the process flowchart shown in FIG. 1, the recovery of lithium from a lithium-containing solution includes the following steps.

(1) Neutralization with acid: a 10 wt % HCl solution is slowly added to a lithium-containing solution at a stirring rate of 300 rpm until the pH value is reduced to 6.0, and stirred for 0.5 h.

(2) Precipitation of aluminum salt: a 5 wt % $NaAlO_2$ is prepared with pure water at a constant temperature of 60° C. and a stirring rate of 300 rpm, and stirred for 30 min. A meta-aluminate solution with a flow rate of 500 mL/min is added to the aluminum salt solution in a molar ratio of Li:Al of 1.1:2 by using a peristaltic pump at a stirring rate of 300 rpm and a constant temperature of 60° C. Flow rates of the lithium salt and the aluminum salt are determined according to concentrations of the lithium-containing solution and the meta-aluminate solution and the molar ratio of Li:Al. After the mixing is finished, stirring is further performed for 30 min to make reactants in the solution react completely.

(3) Standing for aging: the solution after the reaction is further aged at 25° C. for 12 h, to obtain a precipitation solution containing a first precipitate of $Li(OH)\cdot 2Al(OH)_3\cdot nH_2O$.

(4) Neutralization and conversion: a 10 wt % HCl solution is slowly added to the precipitation solution for neutralization at a stirring rate of 300 rpm, to obtain a precipitate of $Li_aX\cdot 2Al(OH)_3\cdot nH_2O$. The pH value is monitored during the neutralization, and the stirring is further performed for 30 min after the pH value is adjusted to 6.0.

(5) Filtering and washing 1: a precipitate is filtered out by using a vacuum filter with a 500-mesh filter cloth under a negative pressure of 0.04 MPa. The precipitate is spray-washed with pure water during the filtering with a ratio of a spraying water amount per unit time to a lithium adsorbent of 0.5 L/kg. A filtrate after the filtering and washing is filtered again by using a precise bag filter with a precision of 3 μm.

The collected tiny particles are returned for aging, and a first filtrate is obtained.

(6) Desorption of lithium: the filtered and washed $Li_aX\cdot 2Al(OH)_3\cdot nH_2O$ is mixed with water in a mass ratio of 1:20 at a constant temperature of 40° C., and stirred at a rate of 300 rpm for 3 h. Filtering and washing are performed, to obtain a lithium adsorbent of $(1-m)Li_aX\cdot 2Al(OH)_3\cdot nH_2O$ (with a D50 particle size of 36.86 μm) and a $Li_aX$-containing filtrate. A mesh number of the filter medium is 500, and the negative pressure of the filter is 0.04 MPa. A filtrate after the filtering is filtered again by using the precise bag filter with a precision of 3 μm. Tiny particles are collected and returned for aging.

(7) Precipitation of lithium: the $Li_aX$-containing filtrate is evaporated and concentrated to a 22 g/L concentration of lithium in the filtrate. The evaporated and concentrated solution is heated to and kept at 90° C., and 10 wt % $Na_2CO_3$ is added at a stirring rate of 300 rpm, where the added amount is 1.2 times a theoretical calculation amount. After the addition is finished, the stirring is further performed for 0.5 h, and standing is performed for 2 h.

(8) Filtering and washing 2: a precipitate of $Li_2CO_3$ is filtered out by using a vacuum filter with a 300-mesh filter medium under a negative pressure of 0.04 MPa. The precipitate is spray-washed with pure water during the filtering with a ratio of a spraying water amount per unit time to $Li_2CO_3$ of 0.5 L/kg. A second filtrate is obtained and added to the lithium-containing solution in step (1).

(9) Drying: the precipitate is dried in a blast drying oven at 130° C. for 120 min, to obtain a $Li_2CO_3$ product.

An adsorption of balance lithium is also included as follows: the lithium-desorbed precipitate (that is, the lithium adsorbent) in step (6) is added to the first filtrate containing balance lithium obtained in step (5) at a stirring rate of 300 rpm with a solid-liquid ratio of the lithium adsorbent to the first filtrate of 1:20 (that is, 1 kg of adsorbent is added per 20 L of filtrate), and stirred at a constant temperature of 40° C. for 90 min.

Filtering and washing 3: a remaining liquid after the adsorption of balance lithium is filtered by using a vacuum filter with a 500-mesh filter medium under a negative pressure of 0.04 MPa. $LiCl\cdot 2Al(OH)_3\cdot nH_2O$ after the adsorption of balance lithium is filtered out. The filtered matter is spray-washed with pure water during the filtering with a ratio of a spraying water amount per unit time to the adsorbent of 0.5 L/Kg. Lithium-desorbed is performed on the filtered matter. The filtrate is filtered for a second time by using a precise bag filter with a precision of 3 μm, and the second time filtered matter is returned for aging, and the filtrate is discharged. A second precipitate of $Li_aX{\cdot}2Al(OH)_3{\cdot}nH_2O$ is obtained.

The second precipitate is mixed with water and stirred to undergo the above desorption of lithium to obtain a second lithium adsorbent $(1-m)Li_aX{\cdot}2Al(OH)_3{\cdot}nH_2O$ (with a D50 particle size of 36.86 μm) and a second $Li_aX$-containing filtrate (parameters in this process are the same as the parameters adopted for the desorption of lithium in step (6)).

The second $Li_aX$-containing filtrate is subjected to the precipitation of lithium, and filtered, washed, and dried to obtain $Li_2CO_3$ (parameters in this process are the same as the parameters adopted in step (7) precipitation of lithium, step (8) filtering and washing 2, and step (9) drying).

Embodiment 2

Figure 2:
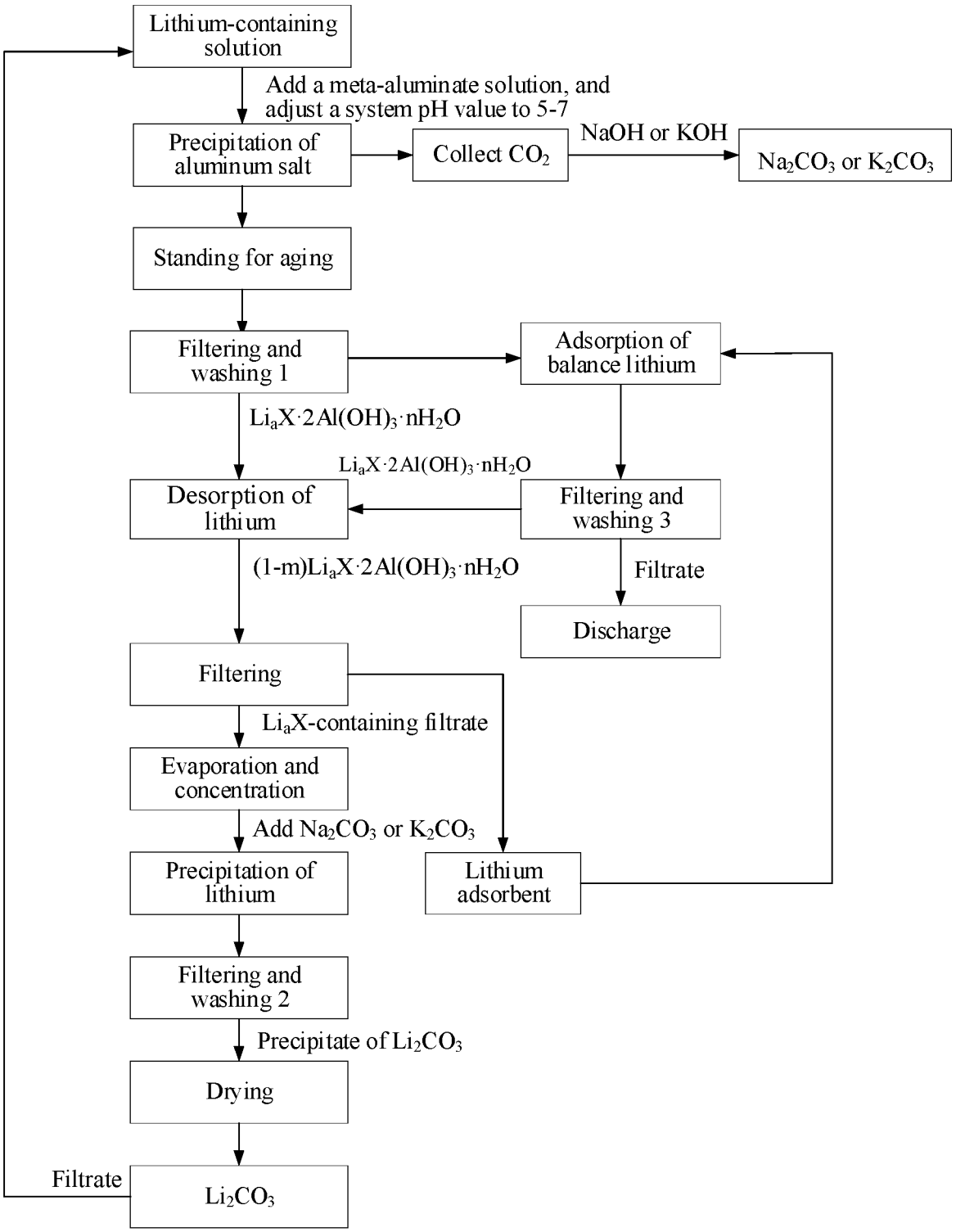
FIG. 2 is a process flowchart of lithium recovery according to Embodiment 2 of the disclosure.

Referring to the process flowchart shown in FIG. 2, the recovery of lithium from a lithium-containing solution includes the following steps.

(1) Precipitation of aluminum salt: a 5 wt % $NaAlO_2$ is prepared with pure water at a constant temperature of 60° C. and a stirring rate of 300 rpm, and stirred for 30 min. A meta-aluminate solution with a flow rate of 500 mL/min is added to the aluminum salt solution in a molar ratio of Li:Al of 1.1:2 by using a peristaltic pump at a stirring rate of 300 rpm and a constant temperature of 60° C. Flow rates of the lithium salt and the aluminum salt are determined according to concentrations of the lithium-containing solution and the meta-aluminate solution and the molar ratio of Li:Al. In addition, a 10 wt % HCl solution is slowly added to the lithium-containing solution until the pH value is reduced to 6.0, and stirred for 30 min, so that reactants in the solution react completely, to obtain a precipitate of $Li_aX{\cdot}2Al(OH)_3{\cdot}nH_2O$.

Subsequent operations of standing for aging, filtering and washing 1, adsorption of balance lithium, desorption of lithium, precipitation of lithium, filtering and washing 2, filtering and washing 3, and drying are all the same as those in Embodiment 1. A lithium adsorbent $(1-m)Li_aX{\cdot}2Al(OH)_3{\cdot}nH_2O$ with a D50 particle size of 40.11 μm is obtained.

Embodiment 3

The difference between Embodiment 3 and Embodiment 1 is that: in the process of precipitation of aluminum salt in step (2), the molar ratio of Li:Al is 1.3:2. Other conditions and operations are all consistent with those of Embodiment 1. A lithium adsorbent $(1-m)Li_aX{\cdot}2Al(OH)_3{\cdot}nH_2O$ with a D50 particle size of 41.28 μm is obtained.

Embodiment 4

The difference between Embodiment 4 and Embodiment 1 is that: in the process of precipitation of aluminum salt in step (2), the molar ratio of Li:Al is 1.2:2. Other conditions and operations are all consistent with those of Embodiment 1. A lithium adsorbent $(1-m)Li_aX{\cdot}2Al(OH)_3{\cdot}nH_2O$ with a D50 particle size of 38.19 μm is obtained.

Embodiment 5

The difference between Embodiment 5 and Embodiment 1 is that: in the process of desorption of lithium in step (6), the temperature is controlled to 20° C. Other conditions and operations are all consistent with those of Embodiment 1. A lithium adsorbent $(1-m)Li_aX{\cdot}2Al(OH)_3{\cdot}nH_2O$ with a D50 particle size of 43.87 μm is obtained.

Embodiment 6

The difference between Embodiment 6 and Embodiment 1 is that: in the process of desorption of lithium in step (6), the temperature is controlled to 60° C. Other conditions and operations are all consistent with those of Embodiment 1. A lithium adsorbent $(1-m)Li_aX{\cdot}2Al(OH)_3{\cdot}nH_2O$ with a D50 particle size of 40.41 μm is obtained.

Embodiment 7

The difference between Embodiment 7 and Embodiment 1 is that: in the process of precipitation of lithium in step (7), the added amount of $Na_2CO_3$ is 1.05 times the theoretical calculation amount. Other conditions and operations are all consistent with those of Embodiment 1. A lithium adsorbent $(1-m)Li_aX{\cdot}2Al(OH)_3{\cdot}nH_2O$ with a D50 particle size of 37.13 μm is obtained.

Embodiment 8

The difference between Embodiment 8 and Embodiment 1 is that: in the process of precipitation of lithium in step (7), the added amount of $Na_2CO_3$ is 1.3 times the theoretical calculation amount. Other conditions and operations are all consistent with those of Embodiment 1. A lithium adsorbent $(1-m)Li_aX{\cdot}2Al(OH)_3{\cdot}nH_2O$ with a D50 particle size of 39.51 μm is obtained.

Embodiment 9

In Embodiment 9, compared with Embodiment 1, the pressure of all vacuum filtering is adjusted to 0.06 MPa, and other conditions remained unchanged. A lithium adsorbent $(1-m)Li_aX{\cdot}2Al(OH)_3{\cdot}nH_2O$ with a D50 particle size of 44.64 μm is obtained.

Embodiment 10

In Embodiment 10, compared with Embodiment 1, the step of filtering again by using a precise bag filter in the filtering and washing 1, filtering and washing 2, and filtering and washing 3 are omitted, and other conditions remained unchanged. A lithium adsorbent $(1-m)Li_aX{\cdot}2Al(OH)_3{\cdot}nH_2O$ with a D50 particle size of 35.49 μm is obtained.

Embodiment 11

The difference between Embodiment 11 and Embodiment 1 is that: after the neutralization and conversion in step (4), the balance lithium remaining in the first filtrate is not adsorbed by using the lithium adsorbent, and the first filtrate is directly discharged after precise filtering. A lithium adsorbent $(1-m)Li_aX{\cdot}2Al(OH)_3{\cdot}nH_2O$ with a D50 particle size of 38.11 μm is obtained.

The technical solution provided in the disclosure is evaluated from the recovery rate of lithium, the purity of $Li_2CO_3$, the adsorption capacity of the lithium adsorbent, and the concentration of lithium in the discharged liquid. The recovery rate of lithium is determined based on the concentration of lithium (the concentration of $Li^+$: 1.568 g/L) in the discharged liquid and the lithium-containing solution. The purity of $Li_2CO_3$ is determined by determining the content of carbonate ion by potentiometric titration. The concentration of lithium in the discharged liquid is determined by using an inductively coupled plasma (ICP) spectrometer. Test results of the embodiments are recorded in Table 1.

The testing method for the adsorption capacity of the lithium adsorbent is as follows. A lithium-containing brine with a high magnesium-lithium ratio is used for testing, where a concentration of $Li^+$ is 0.0233 wt %, a concentration of $Mg^{2+}$ is 7.8540 wt %, and the mass ratio of Mg:Li in the brine is 337:1. 10 g of lithium adsorbent is weighted, and is used for adsorption in a solid-liquid ratio of 1:50 at room temperature with a stirring rate of 300 rpm and an adsorption time of 90 min. The difference in the concentration of lithium in the brine before and after adsorption is the adsorption capacity of the lithium adsorbent.

TABLE 1

Test results of embodiments and comparative embodiments

| Experiment number | Recovery rate of lithium | Purity of $Li_2CO_3$ | Adsorption capacity (mg Li/g) | Concentration of $Li^+$ in discharged liquid (mg/L) | D50 particle size of lithium adsorbent (μm) |
|---|---|---|---|---|---|
| Embodiment 1 | 98.5% | 99.3% | 9.66 | 22.8 | 36.86 |
| Embodiment 2 | 98.4% | 99.3% | 7.96 | 25.3 | 40.11 |
| Embodiment 3 | 93.4% | 99.4% | 9.89 | 103.2 | 41.28 |
| Embodiment 4 | 95.8% | 99.4% | 9.73 | 65.3 | 38.19 |
| Embodiment 5 | 85.6% | 99.3% | 5.61 | 225.3 | 43.87 |
| Embodiment 6 | 89.0% | 99.4% | 6.68 | 171.8 | 40.41 |
| Embodiment 7 | 95.0% | 99.4% | 9.59 | 26.3 | 37.13 |
| Embodiment 8 | 98.6% | 99.0% | 9.69 | 21.3 | 39.51 |
| Embodiment 9 | 98.5% | 99.6% | 9.63 | 24.3 | 44.64 |
| Embodiment 10 | 95.1% | 98.1% | 9.58 | 76.8 | 35.49 |
| Embodiment 11 | 67.7% | 99.3% | 9.61 | 505.8 | 38.11 |

The test results of Embodiments 1-11 in Table 1 are analyzed by comparison in the following:

(1) It can be learned by comparing the test results of Embodiments 1 and 2 that: the adsorption capacity of the lithium adsorbent prepared in Embodiment 2 is lower than that in Embodiment 1. However, because the balance lithium content of the first filtrate in Embodiment 2 is lower than that in Embodiment 1, the final recovery rates of lithium in the foregoing two embodiments are not much different.

(2) It can be learned by comparing the test results of Embodiments 1, 3, and 4 that: in the step of precipitation of aluminum salt, appropriately excessive lithium in the lithium-containing solution is beneficial for the meta-aluminate to react completely, and there is no aluminum remaining in the system after the reaction, thereby improving the purity of lithium carbonate.

(3) It can be learned by comparing the test results of Embodiments 1, 5, and 6 that: within the same period of time, a low desorption of lithium temperature leads to a small desorption of lithium amount, resulting in decreases in the recovery rate of lithium and in the adsorption capacity of the adsorbent. A high desorption of lithium temperature leads to a large desorption of lithium amount and a high recovery rate of lithium.

(4) It can be learned by comparing the test results of Embodiments 1, 7, and 8 that: appropriately excessive sodium carbonate can ensure the level of the lithium ion involved reaction level in the system, thereby increasing the recovery rate of lithium.

(5) It can be learned by comparing the test results of Embodiments 1 and 9 that: an increase in the negative pressure of the vacuum filtering can improve the purity of the $Li_2CO_3$ prepared.

(6) It can be learned by comparing the test results of Embodiments 1 and 10 that: the loss of tiny particles can be avoided by filtering again, which can further increase the recovery rate of lithium, and prevent the tiny particles from entering the step of precipitation of lithium, resulting in a decrease in the purity of lithium carbonate.

1(7) It can be learned by comparing the test results of Embodiments 1 and 11 that: in Embodiment 11, compared with Embodiment 1, the balance lithium remaining in the first filtrate does not undergo adsorption, and therefore the recovery rate of Embodiment 1 is higher than the recovery rate of Embodiment 11.

The foregoing descriptions are exemplary embodiments of the disclosure. It should be noted that, a person of ordinary skill in the art can further make several improvements and refinements without departing from the principle of the disclosure, and the improvements and refinements shall fall within the protection scope of the disclosure.

What is claimed is:

1. A method for recovering lithium from a lithium-containing solution, comprising:

(1) precipitating lithium from the lithium-containing solution by a) or b):

a) regulating the lithium-containing solution by adjusting a pH value of the lithium-containing solution to 5-6, mixing the regulated lithium-containing solution with a meta-aluminate solution, and standing for aging, to obtain a precipitation solution containing a first precipitate of $Li(OH)\cdot 2Al(OH)_3\cdot nH_2O$, wherein n=1-3;

during the adjusting of the pH value of the lithium-containing solution, collecting carbon dioxide produced by the lithium-containing solution and injecting the collected carbon dioxide produced by the lithium-containing solution into an alkaline solution to obtain a carbonate; and regulating the precipitation solution by adjusting a pH value of the precipitation solution to 6-7, and performing filtering and washing on the regulated precipitation solution, to obtain a precipitate of $Li_aX\cdot 2Al(OH)$ $_3 \cdot nH_2O$ and a first filtrate, wherein X represents an anion of an acid solution used in the adjusting of the pH value of the precipitation solution, and a=1 or 2; or b) mixing the lithium-containing solution with a meta-aluminate solution to obtain a first mixture, regulating the first mixture by adjusting a pH value of the first mixture to 5-7, standing for aging, and performing filtering and precipitating on the regulated first mixture after the aging, to obtain a precipitate of $Li_aX \cdot 2Al(OH)_3 \cdot nH_2O$ and a first filtrate, wherein X represents an anion of an acid solution used in the adjusting of the pH value of the first mixture, n=1-3, and a=1 or 2; and during the adjusting of the pH value of the first mixture, collecting carbon dioxide produced by the lithium-containing solution and injecting the collected carbon dioxide produced by the lithium-containing solution into an alkaline solution to obtain a carbonate;

(2) desorption of lithium: mixing the precipitate of $Li_aX \cdot 2Al(OH)_3 \cdot nH_2O$ with water in a mass ratio of 1:1 to 1:50 to obtain a second mixture and stirring the second mixture at 20-60° C. for 1-24 hours, and filtering the second mixture to obtain a lithium adsorbent of $(1-m)Li_aX \cdot 2Al(OH)_3 \cdot nH_2O$ and a first $Li_aX$-containing filtrate, wherein m=0.1-0.9;

(3) precipitation of lithium: evaporating and concentrating the first $Li_aX$-containing filtrate to obtain a concentrated first $Li_aX$-containing filtrate, adding a carbonate into the concentrated first $Li_aX$-containing filtrate to obtain a third mixture, and stirring the third mixture, and performing filtering and washing on the third mixture, to obtain a precipitate of $Li_2CO_3$, wherein a molar ratio of lithium in the first $Li_aX$-containing filtrate to a carbonate ion in the carbonate is 1.05:2 to 1.3:2; and (4) adding the lithium adsorbent to the first filtrate, and performing filtering and washing on the first filtrate to obtain a second precipitate of $Li_aX \cdot 2Al(OH)_3 \cdot nH_2O$ ; and performing the desorption of lithium on the second precipitate to obtain a lithium-desorbed filtrate, and precipitating lithium from the lithium-desorbed filtrate.

2. The method according to claim 1, wherein the adding the lithium adsorbent to the first filtrate comprises stirring the first filtrate with the lithium adsorbent at 20-60° C. such that a lithium ion is adsorbed in the first filtrate.

3. The method according to claim 1, wherein the acid solution comprises one of sulfuric acid, hydrochloric acid, nitric acid, or acetic acid.

4. The method according to claim 1, wherein a D50 particle size of the lithium adsorbent is 20-100 μm.

5. The method according to claim 1, wherein the first $Li_aX$-containing filtrate is evaporated and concentrated to obtain a concentration of lithium of 15-25 g/L.

6. The method according to claim 1, wherein in step (3), the carbonate is added into the concentrated first $Li_aX$-containing filtrate at 50-90° C.

7. The method according to claim 1, wherein the alkaline solution comprises NaOH or KOH, and the carbonate comprises $Na_2CO_3$ or $K_2CO_3$.

8. The method according to claim 1, wherein in step (1) a) or step (1) b), the lithium-containing solution is mixed with the meta-aluminate solution in a molar ratio of Li:Al of 1.05:2 to 1.3:2.

9. The method according to claim 1, wherein in step (3), a second filtrate is obtained when obtaining the precipitate of $Li_2CO_3$, and the method further comprises: adding the second filtrate to the lithium-containing solution.

10. The method according to claim 1, wherein the filtering is performed under a negative pressure of 0.04-0.07 MPa, and a mesh number of a filter medium for the filtering is 300-5000.

* * * * *